United States Patent [19]

Giaume

[11] 3,975,850

[45] Aug. 24, 1976

[54] PORTABLE DISPLAY DEVICE

[76] Inventor: Antoine S. B. Giaume, 35 Sagamore Road, Bronxville, N.Y. 10708

[22] Filed: Apr. 10, 1975

[21] Appl. No.: 566,717

[52] U.S. Cl. ..... 40/125 H; 160/135; 181/30; 211/198

[51] Int. Cl.[2] ..... G09F 7/18

[58] Field of Search ..... 40/125 H, 125 K, 125 R, 40/125 F, 125 G, 129 R, 125 N; 211/178 R; 52/81, 70, 71, DIG. 10 D, 38; 160/135, 351; 248/165, 163, 440; 181/30

[56] References Cited

UNITED STATES PATENTS

| | | | |
|---|---|---|---|
| 2,746,187 | 5/1956 | Ennever | 40/125 K |
| 2,909,963 | 10/1959 | Hehn | 40/125 K X |
| 3,002,557 | 10/1961 | Roth et al. | 160/351 |
| 3,180,446 | 4/1965 | Wenger | 160/351 X |
| 3,232,370 | 2/1966 | Jaffe | 160/135 X |
| 3,571,999 | 3/1971 | Downing | 40/125 H X |
| 3,685,666 | 8/1972 | Rose | 40/125 H X |
| 3,817,396 | 6/1974 | Markson | 211/178 R |

*Primary Examiner*—John F. Pitrelli
*Attorney, Agent, or Firm*—Pennie & Edmonds

[57] ABSTRACT

A portable display device is disclosed for use at trade shows and exhibitions which comprises a light-weight collapsible frame and a plurality of visual display panels which may be attached to the frame. The display stand provides a visually-appealing graphic display, which may be broken down, folded, and stored in easily transportable containers.

10 Claims, 6 Drawing Figures

PORTABLE DISPLAY DEVICE

BACKGROUND OF THE INVENTION

This invention relates to a portable display stand for providing a graphic display for use at trade shows, exhibitions, and the like.

Free-standing graphic displays are widely used by companies as advertising exhibits at trade shows and exhibitions. These exhibits are typically prefabricated displays which are transported unassembled to the exhibition hall and assembled at the site. Usually a company will set up a particular advertising exhibit in at most only a few trade shows a year, with each trade show ordinarily lasting only three or four days. This means that the exhibit must spend most of its time in storage. Furthermore, different trade shows are ordinarily in widely different geographical locations so that the exhibit must be shipped from the storage location to a distant exhibition site. Prior-art prefabricated graphic displays for use at trade shows are often bulky even before assembly, as well as heavy, and therefore are inconvenient to store, expensive to ship, and unwieldy to truck about the exhibition hall. In addition prior-art displays often require a crew of workmen at the exhibition site to assemble them, which adds considerably to the expense of mounting the exhibit.

I have invented a light-weight portable display stand which presents an attractive graphic display exhibit and which may be broken down, folded, and stored in a compact, easily transportable container.

SUMMARY OF THE INVENTION

The present invention relates to a portable, light-weight display device comprising a collapsible frame on which may be mounted a plurality of visual display panels. The display stand may be fabricated to fill a show space as large as eight feet tall by ten feet wide or even larger.

The visual display panels may be of a variety of shapes. One embodiment of the invention for example employs nine rectangular, square, and triangular panels to form a graphic display with an attractive concave shape which is approximately eight feet by ten feet in size. A large variety of graphics of various kinds may be mounted on the panels, and different sets of panels may be used with a single collapsible frame to provide for different graphic displays economically. The display panels are preferably made of a light weight material such as corrugated paper. In other embodiments the display panels may incorporate screens or frosted glass for front or rear film and slide projection.

The collapsible frame may be fabricated from light weight structural material such as square aluminum tubing. The frame may be made up of two or more upright support members which provide vertical support for the display and may extend to almost eight feet in length when incorporated in a completed display stand. The support members are preferably provided with two or more hinged joints so that they may be broken down for transportation and storage. The vertical support members are also preferably fitted with crank bolts or other structural fasteners for attaching the other elements of the frame to the supports. A variety of triangular support members, polygonal frames, and strut members may be connected to the upright support members and with one another to form the collapsible frame. The entire frame structure may be unpacked from its containers and assembled in a short time by a single person without the use of any tools.

The display stand of the present invention may be quickly and easily broken down by removing the detachable visual display panels, disconnecting the elements of the frame from one another as described in more detail below, and folding up the hinged upright support members. The frame thus broken down, the visual display panels, and all hardware necessary for installing the stand may then be packed in compact containers which are preferably only slightly larger in length and width than the largest display panel.

The exhibit may be provided with a pair of flood lights attached to the upper perimeter of the collapsible frame for lighting the graphic display.

In addition to serving as a graphic display the present invention may be used to advantage as a sound reflector. A person delivering a talk with the display stand behind him will have his voice reflected from the display and outward to his audience.

Display stands of a variety of shapes may be made with the present invention for use in show spaces of various sizes and layouts.

BRIEF DESCRIPTION OF THE DRAWINGS

The preferred embodiments of the invention are described below with reference to the following drawings.

DETAILED DESCRIPTION OF THE PREFERRED EMBODIMENTS

Figure 1:
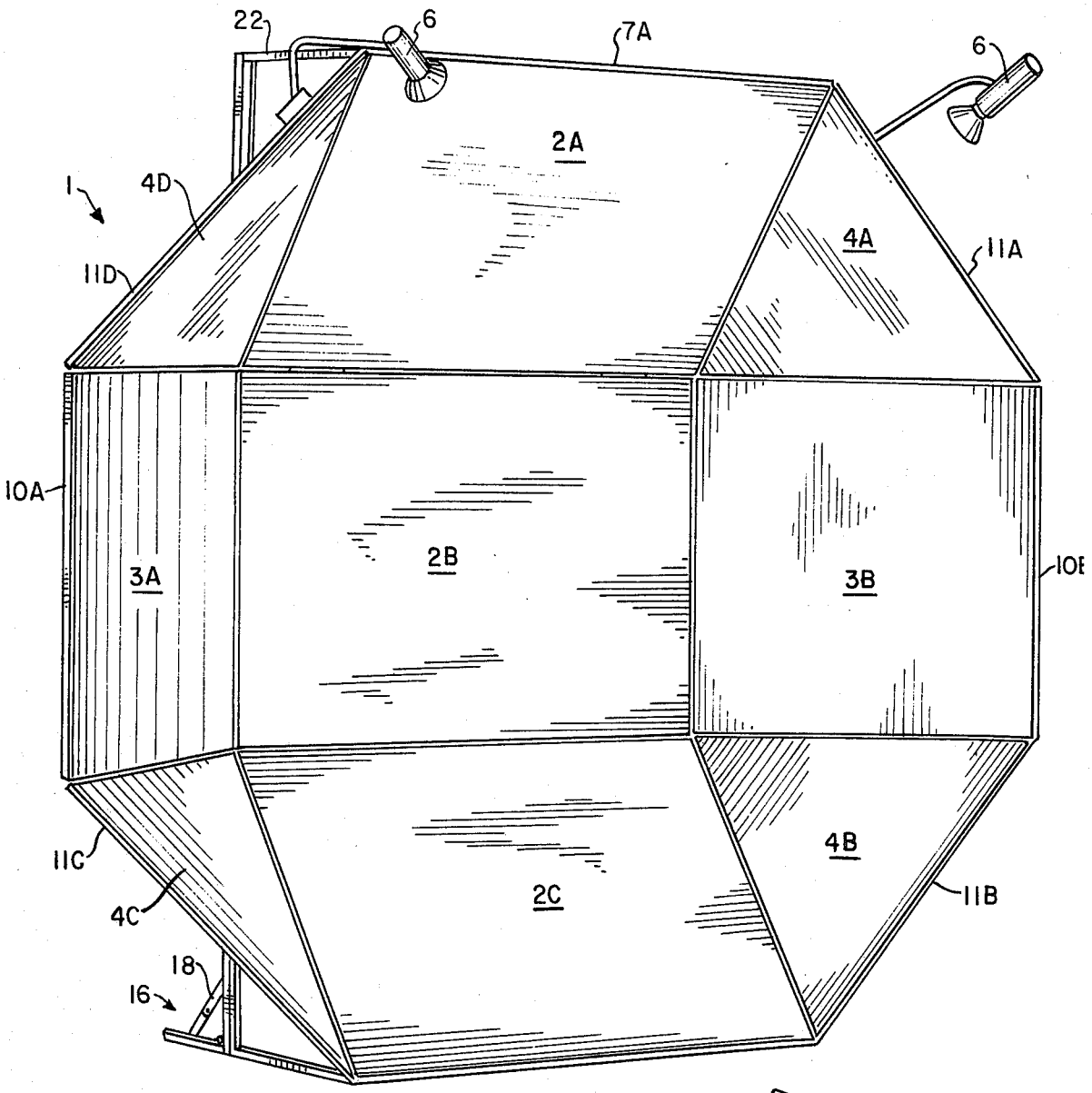
FIG. 1 is an oblique view of a portable display stand of the present invention.

Referring now to FIG. 1 a display stand 1 is shown which employs nine visual display panels 2A through 4D: three rectangular visual display panels 2A through 2C, two square visual display panels 3A and 3B, and four triangular visual display panels 4A through 4D. The visual display panels are detachably mounted to a collapsible frame 5 which is only partially visible in FIG. 1. The edges of the panels are preferably close together so that the collapsible frame 5 is not noticable when display 1 is viewed from the front. A pair of electric flood lamps 6 are provided for illuminating the display. In this display the collapsible frame is dimensioned and connected together so as to hold the panels 2A–4D in a concave arrangement.

The visual display panels of the present invention are preferably made of a light weight, strong, fire-proof material. A corrugated paper material which is suitable for the display panels of the present invention is sold under the trade name of "Laminate" by Tri-Wall Containers, 100 Crossway Park West, Woodbery, New York. The edges of the panels are preferably protected by attaching clear plastic channeling over them. A large variety of graphics may be mounted on the visual display panels of preferred embodiments of the invention: photographic prints, pastel prints, preprinted materials, photostats, textile fabric, metal foils, and reflective materials. In certain applications it may be desirable to silk screen directly on the visual display screen panels. Transparent or semi-transparent plastics such as "Plexiglass" may also be used for the visual display panels if rear lighting is desired. Screens or frosted glass may be incorporated in the visual display panels for front or rear projection of slides and movies.

A display stand similar to the one shown in FIG. 1 may be fabricated with dimensions 9 feet-5 inches by 7 feet-10 inches when fully assembled and which may be broken down, folded, and stored in two containers of 3 feet by 5 feet by 4 inches with a total weight of less than 130 pounds. This display stand may be assembled by a single person in approximately one half hour without the use of any tools.

Figure 2:
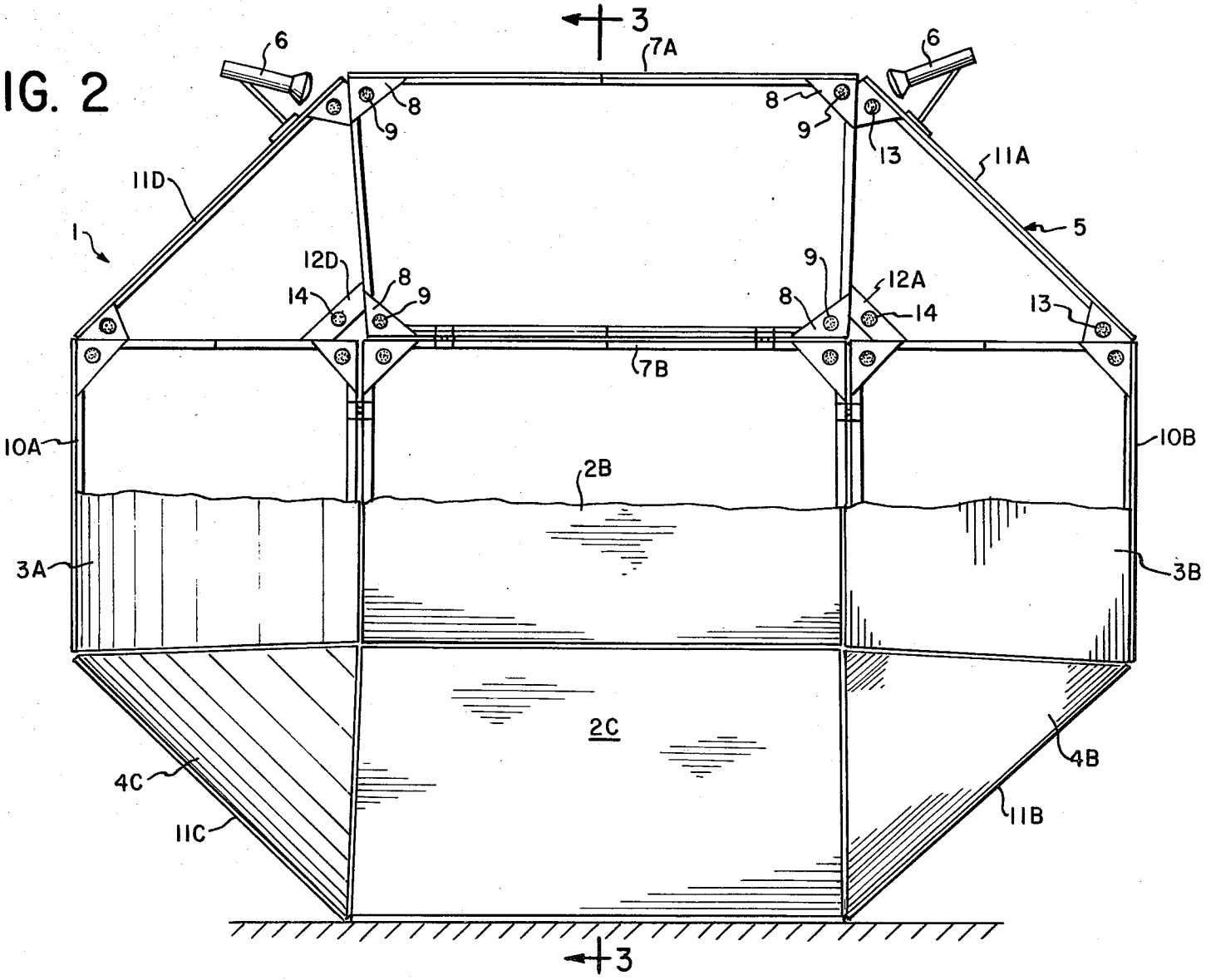
FIG. 2 is a front view of the embodiment shown in FIG. 1 with several of the visual display panels removed or broken away to show a portion of the collapsible frame behind the panels.

FIG. 2 shows display stand 1 viewed from the front with the upper visual display panels removed or broken away. The upper portion of collapsible frame 5 is therefore visible. Rectangular frame 7A is provided for supporting the topmost rectangular visual display panel 2A. Rectangular frame 7A is made rigid by braces 8 located at its four corners. Mounted on corner brace 8 is fastening means 9 for attaching visual display panel 2A to rectangular frame 7A as described in greater detail below.

Rectangular frame 7A is detachably connected along its bottom side with the top side of rectangular frame 7B. Square frames 10A and 10B are detachably connected to opposite sides of rectangular frame 7B. Similarly a third rectangular frame 7C, not shown in FIG. 2, is detachably connected to the lower side of rectangular frame 7B. Strut member 11A connects a corner of rectangular frame 7A with a corner of square frame 10B and similarly strut members 11B, C, and D connect corners of corresponding rectangular and square frames. Corner insert 12A is positioned between adjacent corners of rectangular frame 7A and square frame 10B. Similar corner inserts 12B through 12D are provided in corresponding locations between rectangular and square frames. Mounted on both ends of strut members 11A through 11D are fastening means 13. Corner inserts 12A and 12D are also provided with identical fastening means 14. Fastening means 13 and 14 are provided for attaching triangular panel 4A to collapsible frame 5.

Flood lamps 6 are detachably connected along the upper perimeter of collapsible frame 5 on strut members 11A and 11D.

Figure 3:
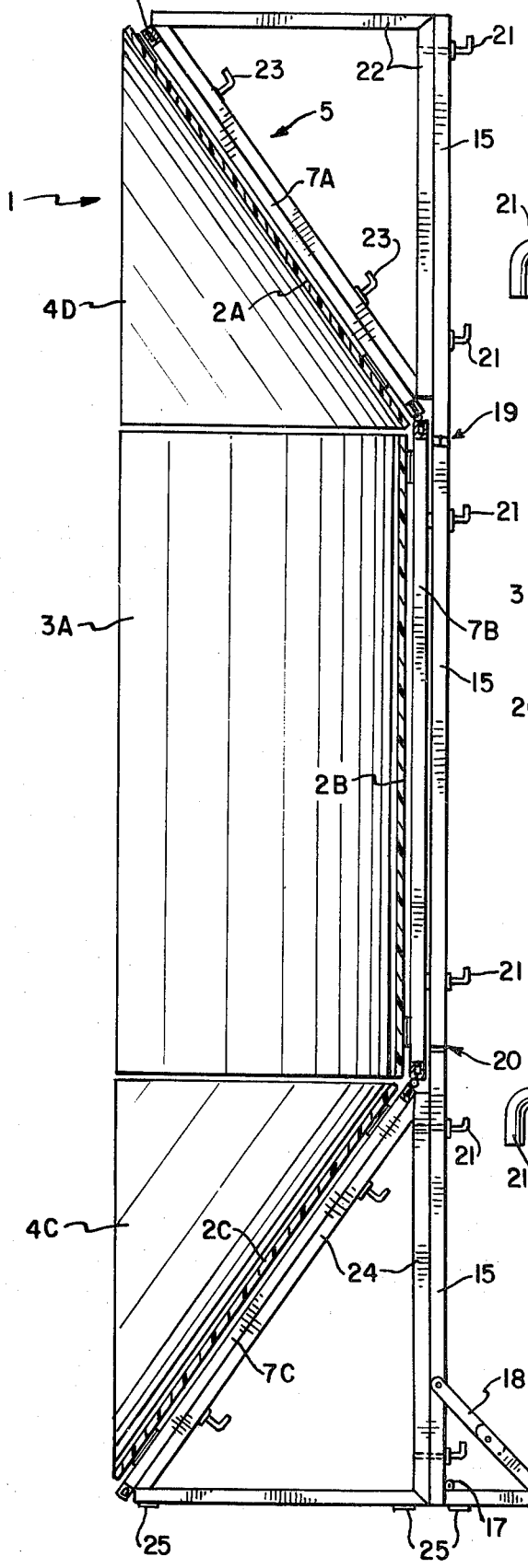
FIG. 3 is a cross-sectional view taken along line 3—3 of FIG. 2.

FIG. 3 shows a cross-sectional view of the display device taken along line 3—3 at FIG. 2. Upright support member 15 extends up the back of the display stand, providing vertical support. At the base of upright support member 15 is a foot member 16 which is attached to the support member by means of a hinge 17 and is braced by folding brace 18. Upright support member 15 is provided with two joints 19 and 20 at which it is hinged. Support member 15 may therefore be folded to a length approximately equal to one-third its length when fully extended. Crank bolts 21 are provided along the length of upright support member 15 for attaching other elements of the frame thereto. Crank bolts are particularly advantageous for this application in that they facilitate the attaching of other elements to the upright support members without requiring tools; however other structural fasteners may be used in place of crank bolts.

Attached to the top of the upper portion to the upright support member 15 by means of crank bolts 21 is triangular support member 22. Triangular support member 22 is in turn connected to one side of rectangular frame 7A by means of crank bolts 23. Similarly, triangular support member 24 is connected to the lower portion of upright support member 15 and to rectangular frame 7C. Both foot member 16 and triangular support member 24 are fitted with rubber feet 25 for resting against the floor. Rectangular frame 7B is rigidly and detachably attached to upright support member 15 by means of crank bolts. Visual display panels 2A through 2C are connected to the corresponding rectangular frames 7A through 7C.

Figure 4:
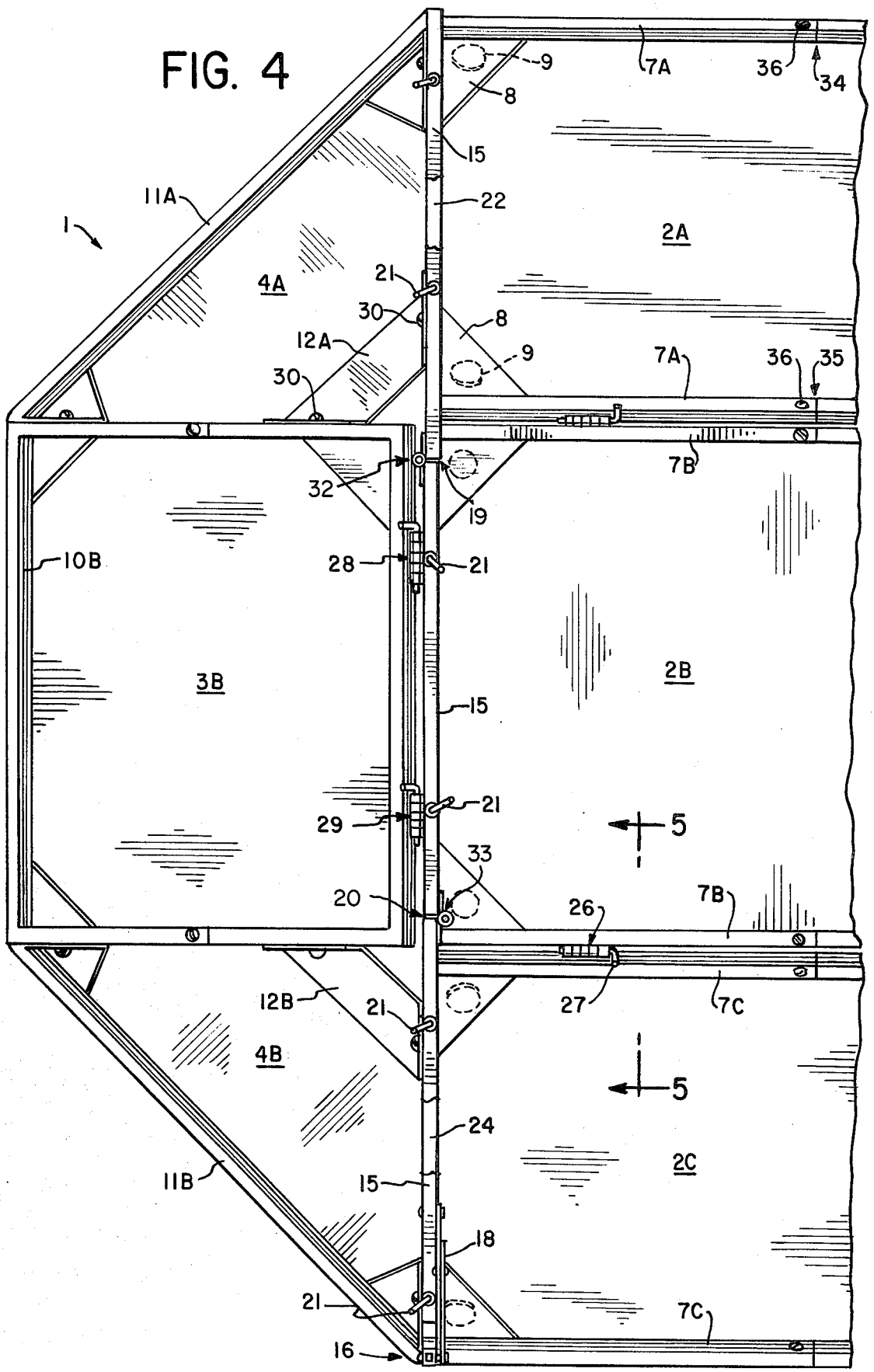
FIG. 4 is a rear view showing a portion of the display stand in FIG. 1.

Referring now to FIG. 4, a rear view of part of the display stand, the upper side of rectangular frame 7C is connected to the corresponding lower side of rectangular frame 7B by means of pin hinge 26 and a second pin hinge located to the right which is not shown. These two rectangular frames may be detached from one another by removing pin 27 from pin hinge 26 and by removing the corresponding pin from the pin hinge referred to above which is not shown. Similarly, square frame 10B is attached to rectangular frame 7B by means of a pair of pin hinges 28 and 29.

Corner insert 12A is detachably connected to the sides of frames 7A and 10B with structural fasteners 30. Wing nuts are preferred for structural fasteners 30 and 31 since they permit the corner inserts and strut members to be attached without the use of special tools.

Upright support member 15 is shown with hinges 32 and 33 at joints 19 and 20 respectively. In other embodiments joints 19 and 20 instead of being hinged may break apart completely allowing upright support member 15 to be separated into three separate sections. In these embodiments plugs may be provided for insertion into adjacent ends of the sections to make joints 19 and 20 rigid when assembled.

Rectangular frame 7A may be broken apart into two "U-shaped" sections at joints 34 and 35, which are made rigid by plugs (not shown) which are inserted in the hollow sides of the frame. The plugs are held in place by structural fasteners 36, which are preferably of the same type as structural fasteners 30 and 31. Extension bars may be provided for insertion between the two U-shaped sections referred to for adjusting the dimensions of the rectangular frame.

Figure 5:
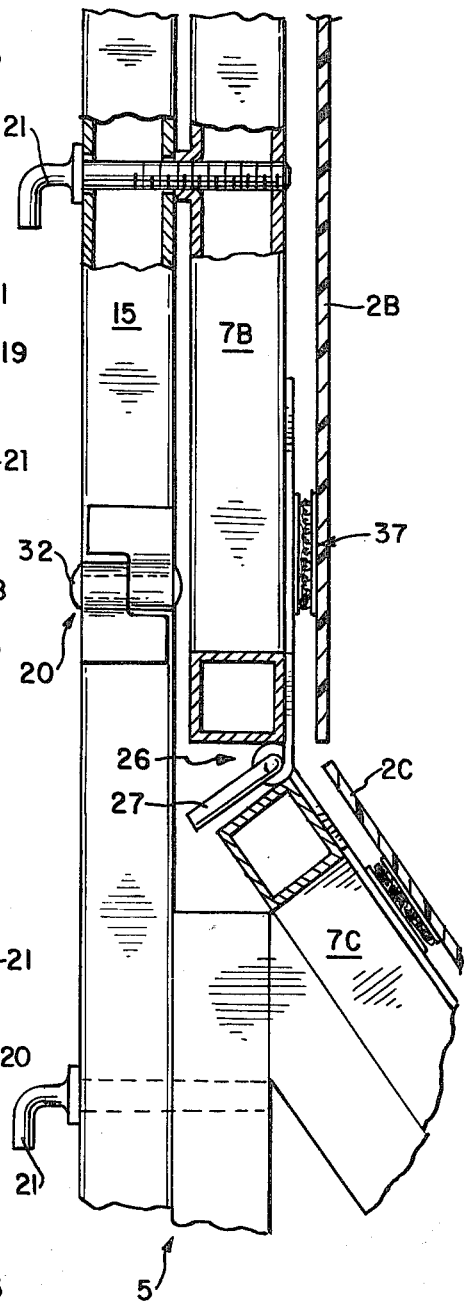
FIG. 5 is a cross-sectional view taken along 5—5 of FIG. 4.

FIG. 5 shows in detail certain of the detachable and folding hinges and connectors which permit the present invention to be broken down and folded into a compact package. Visual display panel 2B is attached to rectangular frame 7B with fastening means 37 made of hook and loop fastening material of the type sold under the trade name "Velcro" by the Velcro Corporation, 681 Fifth Avenue, New York, New York. Since the hook material is more fragile than the loop material, in preferred embodiments of this invention the hook material is attached to the visual display panels and the loop material is attached to the heavier metal frames. Crank bolt 21 connects rectangular frame 7B to upright support member 15.

Fully-assembled display stand 1 shown in FIG. 1 may be quickly and easily disassembled in the following manner: visual display panels 2A–4D may be removed from collapsible frame 5, strut members 11A–11D and corner inserts 12A–12D may be detached from the rectangular and square frames to which they are joined, square frames 10A and 10B may be disconnected from rectangular frame 7B by removing the pins from pin hinges 28 and 29, rectangular frames 7A and 7C may be removed by unscrewing crank bolts 23 and removing the pins from the pin hinge 26 and other pin hinges corresponding to it, triangular support members 22 and rectangular frame 7B may be disconnected from upright support members 15 by unscrewing crank bolts 21, rectangular frame 7A – 7C may each be separated into two "U shaped" sections at joints 34 and 35, flood lamps 6 may be disconnected from strut members 11A and 11D, and upright support member 15 broken at joints 19 and 20 and foot member 16 folded up.

Figure 6:
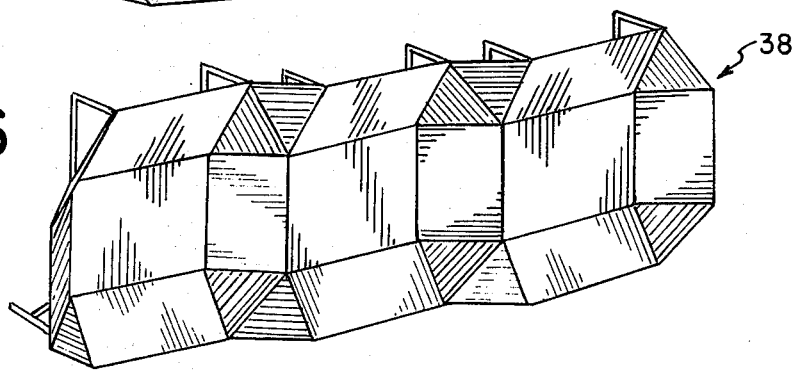
FIG. 6 is an oblique view of another embodiment of the present invention.

FIG. 6 depicts a second embodiment of the present invention, display stand 38, which demonstrates the flexibility of the present invention in providing for display stands of a variety of shapes and sizes. The display stand of FIG. 6 comprises 25 display panels mounted on a collapsible frame comprising six upright support members. Numerous other configurations of the present invention will be obvious to those skilled in the art. With respect to the embodiment shown in FIG. 1, for example, it will be appreciated that square frames may be substituted for rectangular frames 7A–7C and that frames 10A and 10B need not be square. The term "rectangular" refers to square figures as well as to those with adjacent sides which are unequal in length. It will also be appreciated that triangular panels 4A–4D, strut members 11A–11D, and corner inserts 12A–12D may be omitted from the embodiment of FIG. 1, in which case square frames 10A and 10B are free to pivot about pin hinges 28 and 29. Thus the embodiment of FIG. 1 is conveniently adaptable to fit in show spaces of various layouts.

I claim:

1. A portable, light-weight display device comprising a collapsible frame and a plurality of visual display panels detachably fastened to the collapsible frame, the collapsible frame comprising:

a. two upright support members, each of said upright support members comprising:
   i. a braced foot-member attached to one end,
   ii. a plurality of first structural fasteners spaced apart along its length, and
   iii. at least one joint at which said support member may be broken;

b. three rigid rectangular frames at least one of which is rigidly and detachably connected to said two upright support members by means of said first structural fasteners, each of said rectangular frames comprising:
   i. fastening-means in its corners for fastening thereto at least one visual display panel,
   ii. at least two second structural fasteners spaced apart on its perimeter, and
   iii. at least one side whose length substantially equals the length of a side of another of the rectangular frames and which is detachably connected to said corresponding side of said other rectangular frame by means of said second structural fasteners; and c. four rigid triangular support members, each of said triangular support members comprising:
   i. at least two third structural fasteners spaced apart on its perimeter,
   ii. one side whose length substantially equals the length of a side of one of the rectangular frames and which is detachable connected to said corresponding side of said rectangular frame by means of said third structural fasteners, and
   iii. a second side detachably connected to an upright support member by means of said first structural fasteners.

2. The display device according to claim 1 wherein each of the three rectangular frames has a first side, said first sides of the three frames all being substantially equal in length, and a. a first of said three rectangular frames is rigidly and detachably mounted to the two upright support members with its first side being substantially perpendicular to said upright support members and forming the bottom side of said first rectangular frame, b. a second of said three rectangular frames is detachably connected to the bottom side of said first rectangular frame along the first side of the second rectangular frame and is detachably connected to two of the triangular support members along the two adjoining sides, and c. the third of said three rectangular frames is detachably connected to the top side of said first rectangular frame along the first side of the third rectangular frame and is detachably connected to two of the triangular support members along the two adjoining sides.

3. A portable, light-weight composite display device comprising a collapsible frame and a plurality of visual display panels detachably fastened to the collapsible frame, the composite display device including:

a. a first and a second display device according to claim 2, the display devices having substantially the same dimensions;

b. a fourth rigid rectangular frame which comprises
   i. fastening means in its corners for fastening thereto at least one visual display panel,
   ii. at least four second structural fasteners spaced apart on its perimeter, and
   iii. two opposing sides each of whose length substantially equals the length of the sides adjoining the bottom sides of the first rectangular frames of the display devices, one of said opposing sides being detachably connected to a side adjoining the bottom side of the first rectangular frame of the first display device by means of two of the second structural fasteners and the second of said opposing sides being detachably connected to a side adjoining the bottom side of the first rectangular frame of the second display device by means of two of the second structural fasteners, the fourth rectangular frame thereby joining the two display devices together;

c. four strut members, each of said strut members being detachably connected between two corners of two rectangular frames, one of the rectangular frames being detachably connected to the first rectangular frame of the first display device and the other rectangular frame being detachably connected to the first rectangular frame of the second display device, each of said strut members comprising:
   i. fastening means at its ends for fastening thereto at least one visual display panel, and
   ii. at least two fourth structural fasteners at its ends for detachably connecting the strut members between said corners, and d. four corner inserts, each of said corner inserts being detachably connected in a corner of a triangle formed by the frame, the corner being opposite a strut member which forms a side of the triangle, each corner insert comprising:

i. fastening means for fastening thereto at least one visual display panel, and ii. at least two fourth structural fasteners for detachably connecting the corner insert.

4. The display device according to claim 2 further comprising:

a. two fourth rigid rectangular frames, each of said fourth rectangular frames comprising:

i. fastening means in its corners for fastening thereto at least one visual display panel, ii. at least two second structural fasteners spaced apart on its perimeter, and iii. at least one side whose length substantially equals the length of the two sides adjoining the bottom side of said first rectangular frame connected to the upright support members and which is detachably connected to one of said two sides of said first rectangular frame by means of said second structural fasteners;

b. four strut members, each of said strut members being detachably connected between two corners of two rectangular frames which are detachably connected to adjoining sides of said first rectangular frame connected to the upright support members and comprising:

i. fastening means at its ends for fastening thereto at least one visual display panel, and ii. at least two fourth structural fasteners at its ends for detachably connecting the strut members between said corners, and c. four corner inserts, each of said corner inserts being detachably connected between two sides of two rectangular frames which are detachably connected to adjoining sides of said first rectangular frame connected to the upright support members and comprising:

i. fastening means for fastening thereto at least one visual display panel, and ii. at least two fourth structural fasteners for detachably connecting the corner insert between said sides.

5. The display device according to claim 4 wherein the visual display panels mounted on the collapsible frame define a generally concave surface.

6. The display device according to claim 1 wherein said first structural fasteners are crank bolts.

7. The display device according to claim 1 wherein said fastening means is of the hook and loop type.

8. The display device according to claim 1 wherein said second structural fasteners are pin hinges comprising removable pins.

9. The display device according to claim 1 wherein said visual display panels are composed of corrugated paper.

10. The display device according to claim 1 further comprising at least one flood lamp detachably connected to said collapsible frame.

* * * * *